United States Patent [19]

Perry

[11] 4,343,594

[45] Aug. 10, 1982

[54] BLADED ROTOR FOR A GAS TURBINE ENGINE

[75] Inventor: Derick A. Perry, Derbyshire, England

[73] Assignee: Rolls-Royce Limited, London, England

[21] Appl. No.: 123,776

[22] Filed: Feb. 22, 1980

[30] Foreign Application Priority Data

Mar. 10, 1979 [GB] United Kingdom ..... 7908517

[51] Int. Cl.[3] ..... F01D 5/32

[52] U.S. Cl. ..... 416/193 A; 416/220 R; 416/500

[58] Field of Search ..... 416/145, 193 A, 500, 416/220 R, 221

[56] References Cited

U.S. PATENT DOCUMENTS

| | | | |
|---|---|---|---|
| 2,753,149 | 7/1956 | Kurti | 416/221 X |
| 2,836,392 | 5/1958 | Spaeth . | |
| 2,999,668 | 9/1961 | Howald et al. | 416/500 X |
| 3,112,915 | 12/1963 | Morris . | |
| 3,137,478 | 6/1964 | Farrell . | |
| 3,181,835 | 5/1965 | Davis | 416/145 |
| 3,266,770 | 8/1966 | Harlow | 416/220 R |
| 3,748,060 | 7/1973 | Hugoson et al. | 416/220 X |
| 3,751,183 | 8/1973 | Nichols et al. | 416/500 X |
| 3,936,222 | 2/1976 | Asplund et al. | 416/220 R |
| 4,088,421 | 5/1978 | Hoeft . | |

FOREIGN PATENT DOCUMENTS

| | | | |
|---|---|---|---|
| 1263677 | 5/1961 | France | 416/193 A |
| 15893 | of 1909 | United Kingdom . | |

*Primary Examiner*—Everette A. Powell, Jr.

*Attorney, Agent, or Firm*—Cushman, Darby & Cushman

[57] ABSTRACT

This invention relates to a bladed rotor for a gas turbine engine which comprises a disc having blade carrying slots in its periphery. In order to seal the spaces between the blade platforms and the disc an annular array of sealing plates is provided. The plates are supported directly from the disc by a rivet, pin or the like which passes through the disc in between the blade carrying slots, in this way avoiding any additional loading on the blades themselves.

10 Claims, 4 Drawing Figures

BLADED ROTOR FOR A GAS TURBINE ENGINE

This invention relates to a bladed rotor for a gas turbine engine.

The bladed rotors for gas turbine engines normally comprise blade carrying discs, the disc having retaining slots cut in their peripheries in which are mounted the roots of the aerofoil blades supported from each disc. It is usually necessary to provide a shank portion for the blades, this shank portion extending between the blade root and the platform which forms part of the inner boundary of gas flow through the rotor stage. In order to prevent gas leaking through the spaces inbetween the shanks some form of sealing plate is necessary. In the past various constructions of sealing plate have been used. Thus one popular method of retaining the plates is to provide facing grooves on the disc and on the blade platform, the plates being sized to fit between the facing grooves. However, as the size of the shanks and hence of the plates increases it is necessary to thicken the plates to allow them to bear the gas pressures and this results in an unnecessarily heavy construction.

One alternative method which has been proposed lies in the use of an engagement between the plate and the disc which carries centrifugal loads on the plates and additional through-bolt structures which allow the plate to bear the gas loads. This structure is complicated and requires the plates to be formed with machined disc engaging surfaces.

We have made the surprising discovery that it is possible to carry all the loads from the sealing plates directly into the disc by through-bolts or rivets or similar retaining means without unduly comprising the strength of the disc.

According to the present invention a bladed rotor for a gas turbine engine comprises a rotor disc having axially extending blade retention slots in its periphery, a plurality of rotor blades supported by roots which engage with said slots, and at least one annular assembly of sealing plates adapted to provide a seal between the blade platforms and the disc, each said plate being retained against axial, radial and circumferential movement by at least one retaining member extending through the plate and through that portion of the periphery of the disc lying between said slots.

In a preferred embodiment there are two said annular assemblies of plates although it is only necessary that one assembly should be of sealing plates. In this case the retaining members preferably extend through both assemblies of plates.

The retaining member may extend through the plates at a radius substantially halfway between the inner and outer radii of the plate.

The plates may also be used to support other portions of the rotor assembly such as dampers.

Figure 1:
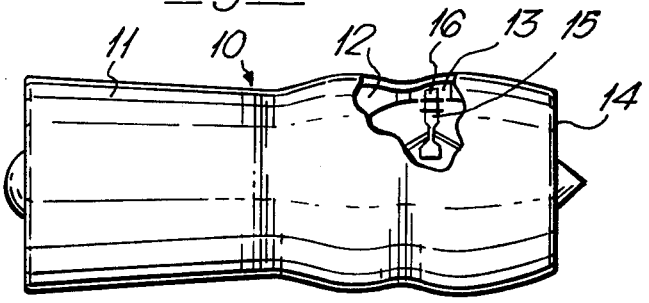
Figure 2:
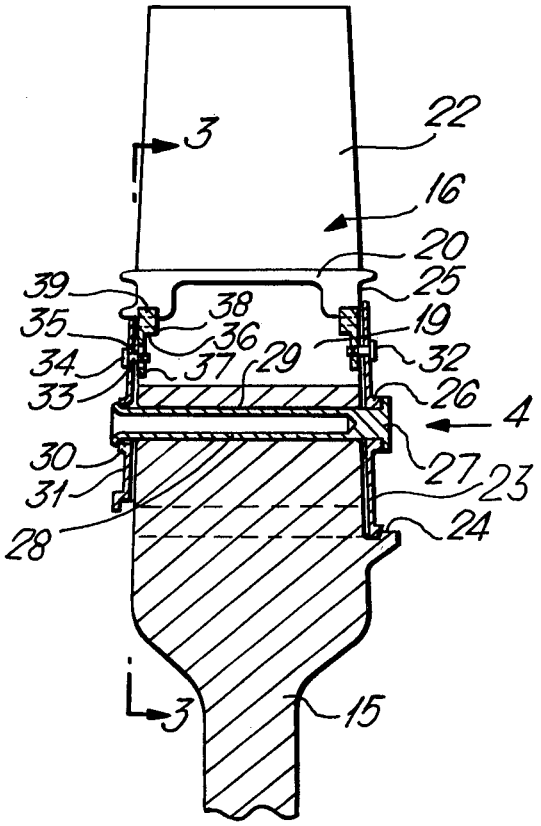
Figure 3:
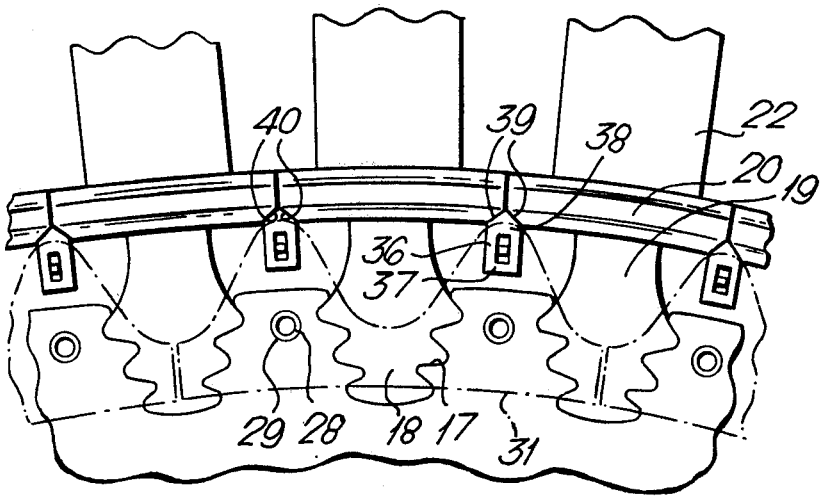
Figure 4:
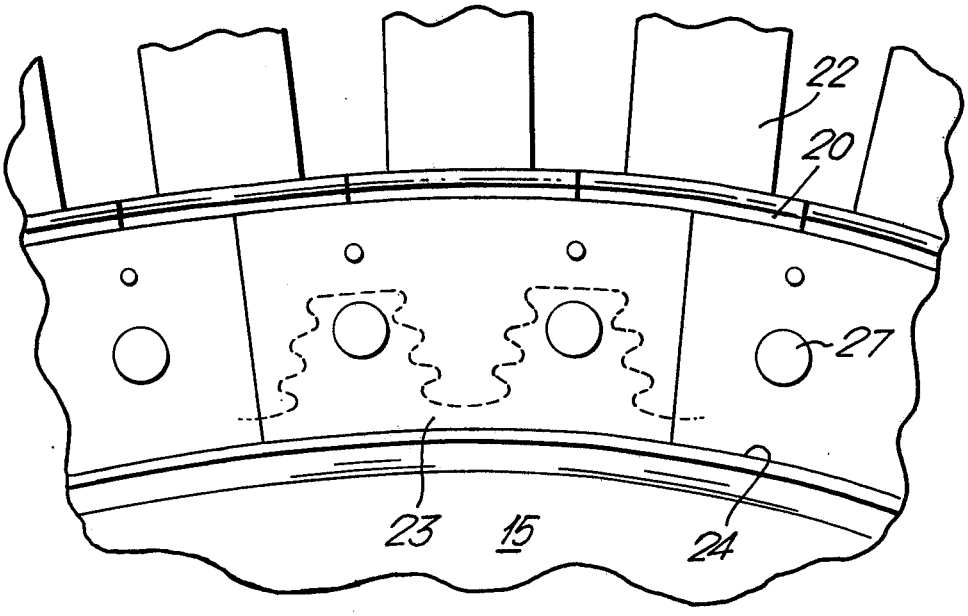

The invention will now be particularly described merely by way of example and with reference to the accompanying drawings in which;

FIG. 1 is a partly broken away view of a gas turbine engine having a bladed rotor in accordance with the present invention, FIG. 2 is a radial section through the rotor disc of FIG. 1, FIG. 3 is a section on the line 3—3 of FIG. 2 and, FIG. 4 is a view on the arrow 4 of FIG. 2.

In FIG. 1 there is shown a gas turbine engine comprising a casing 10 within which there are mounted in flow series a compressor 11, a combustion chamber 12 and a turbine 13. The casing 10 forms a final nozzle 14. Operation of the engine overall is conventional and is not elaborated in the specification.

The casing is broken away in the region of the turbine 13 to expose to view the bladed rotor which forms the turbine rotor of the engine. This rotor comprises a disc 15 from which are supported a row of turbine blades 16. The details of the disc 15 and blades 16 may be seen in FIGS. 2 and 3.

The disc 15 is provided at its periphery with a plurality of axially extending retaining slots 17. In the present embodiment the slots 17 are of the well known fir tree section. In each of the slots 17 there engages one of the correspondingly shaped roots 18 of the blades 16. The root 18 carries a shank portion 19 which in turn carries a platform 20 and an aerofoil 22. The platform 20 and aerofoil 22 perform the aerodynamic function of the blade, the platform 20 defining the inner boundary of the hot gas flow through the stage while the aerofoils 22 extract work from the hot gas.

Clearly there are some additional considerations to be taken into account in the design of the rotor. Thus it is necessary to prevent hot gases escaping underneath the platform 20 and thus bypassing the aerofoil 22 and because the aerofoil 22 is unrestrained at its tip it is necessary to provide some kind of damping for the blade as a whole.

In order to prevent leakage of the hot gas sealing plates 23 are provided. In the present instance these plates are retained to the rear face of the disc 15 and they extend between a groove 24 formed in the rear face of the disc and the end faces 25 of the platforms 20. It will be seen from FIG. 4 that the plates 23 are segmental and that together they form a complete annulus.

In order to retain the plates 23 in position each plate is provided with a pair of circular bosses 26 with which engage heads 27 of two hollow rivets 28. The rivets 28 each pass through one of the apertures 29 drilled through the peripheral portion of the disc which lies between two of the fir tree slots 17. In the present case each of the rivets 28 is peened over at its other end to engage with cylindrical bosses 30 formed in a front assembly of plates 31, shown in broken lines. It will be seen from FIG. 3 that the plates 31 do not act as sealing plates since they have a cut-away form but they are in fact used to support damping means which are described below.

It will be seen that as so far described the plates 23 and 31 are solely supported by the engagement of the rivets 28 with the peripheral portions of the disc 15. We have found that in spite of the general rule that the rim area of a rotor disc is heavily loaded and should not therefore be provided with apertures or other stress raising features, this area between the slots 17 is relatively lightly loaded, and far from increasing the stresses carried by the disc, the provision of these holes 29 may in fact improve the position.

As mentioned above it is also necessary that some form of damping should be provided for the blades. To this end each of the plates 23 and 31 is provided with a pair of retaining studs 32 and 33. The studs 32 and 33 are identical and comprise a head portion 34 which engages with the respective plate and a squared-off portion 35 which extends inwardly of the plate into the space between the shanks 19. On each of the squared-off portions 35 there is engaged a corresponding damper weight. Each of the weights 36 comprises a supporting portion 37 relatively thin in section and having a central radially extending slot which engages the squared-off portion 35 so as to allow the weight substantial radial freedom and a small degree of circumferential freedom and freedom to twist. The outer portion of each weight 36 comprises a heavier section at 38 formed at its outermost extremity with a pair of angled faces 39 forming a shallow wedge.

Each of the weights 36 is arranged to be circumferentially aligned with the junction between two of the platforms 20. Each of the platforms 20 has adjacent to its edge which adjoins the neighbouring platform an angled face 40 whose angle is arranged to match that of the corresponding face 39 of the damper 36.

It will be seen that when the rotor rotates the weights 36 will be forced outwards and will therefore engage with the two faces 40 of the respective adjoining platforms 20. Each platform 20 will be subject to the effect of four of the weights one at each corner. Vibrational movement of the blade which will reflect in movement of the platforms 20 will therefore be damped by the energy involved being converted to heat when the platform moves relative to the damper weight 36.

It will be seen therefore that the present construction provides a way in which the plates 23 and 31 may be supported directly from the disc 15. These plates do not therefore have any effect on the vibration characteristics of the blade, and the full effect of the length of the shank 19 is operational to maximise the effect of dampers 36, The plates 23 are supported by the rivets 28 approximately at their mid-radius. This is clearly the best position to support them to allow them to bear gas loads caused by hot gases attempting to flow underneath the platform 20.

It will be appreciated that there are a number of modifications which could be made to the embodiment described. In particular the hollow rivets 28 could be replaced by other forms of fixing pins or even threaded bolts which would then be reuseable. The plates 23 and 31 could be interchanged or they could both be made as complete sealing plates. The damper weights 36 could be supported from the plates 23 and 31 by other means than the studs 32 described.

I claim:

1. A bladed rotor for a gas turbine engine comprising a rotor disc having axially extending blade retention slots in its periphery, a plurality of rotor blades each having a root which engages with one said slot to support the blade and at least one annular assembly of sealing plates adapted to provide a seal between the blade platforms and the disc, a retaining member associated with each said plate, each said retaining member extending through the plate and through that portion of the periphery of the disc lying between said blade retention slots, said retaining member assuming loads of its respective plate and distributing such loads across the thickness of said disc thereby eliminating localized stress build-up in said disc from the respective one of said plates and also eliminating loads from the respective one of said plates on said blades, said retaining member restraining the respective plate against axial, radial and circumferential motion.

2. A bladed rotor as claimed in claim 1 and comprising a second assembly of plates retained against the face of the disc opposite to said sealing plates by engagement with said retaining members.

3. A bladed rotor as claimed in claim 1 and in which said retaining member comprises a rivet.

4. A bladed rotor as claimed in claim 1 and in which there is a groove formed in said disc with which said sealing plates engage at their inner periphery.

5. A bladed rotor as claimed in any one of claims 1, 2, 3 or 4 in which there are two said retaining members for retaining each plate, said two retaining members extending respectively through adjacent portions of the periphery of the disc between the blade retention slots.

6. A bladed rotor as claimed in any of claims 1, 2, 3 or 4 and in which each said plate carries further portions of the structure of the bladed rotor.

7. A bladed rotor as claimed in any one of claims 1, 2, 3 or 4 and in which said retaining members engage with said plates at a position substantially midway between the inner and outer peripheries of said plates.

8. A bladed rotor as claimed in claim 6 in which each of said blades includes a platform adjoining the platforms of adjacent blades, and in which said further portions carried by each of said plates includes a dampening weight free to move sufficiently radially outwardly to frictionally engage inner surfaces of adjoining adjacent platforms.

9. A bladed rotor as claimed in claim 8 in which said platforms comprise angled inner surfaces where they adjoin and in which said weights comprise correspondingly angled outer surfaces which form a shallow wedge and engage with the angled surfaces of the adjoining platforms.

10. A bladed rotor as claimed in claim 8 in which each of said dampening weights includes a longitudinally extending slot, and in which each of said plates is provided with a projection extending into said slot to retain the respective weight to the plate.

* * * * *